US007815399B2

(12) United States Patent
Kwon et al.

(10) Patent No.: US 7,815,399 B2
(45) **Date of Patent: *Oct. 19, 2010**

(54) METHOD OF MECHANIZED CONSTRUCTION FOR EARTH WIRE UNDER-BRACING AND EXTENDABLE EXCAVATING UNIT FOR AUGER CRANE

(75) Inventors: Sae Won Kwon, Goesan-Gun (KR); Dong Hwi Shin, Seongnam-Shi (KR); Dong Hwan Park, Cheongju-Shi (KR)

(73) Assignee: Daewon Electric Co. Ltd., Jinchun-Eup, Jinchun-Gun, Choongchungbuk-Do (KR)

( * ) Notice: Subject to any disclaimer, the term of this patent is extended or adjusted under 35 U.S.C. 154(b) by 147 days.

This patent is subject to a terminal disclaimer.

(21) Appl. No.: 11/990,514

(22) PCT Filed: Oct. 10, 2006

(86) PCT No.: PCT/KR2006/004063

§ 371 (c)(1),
(2), (4) Date: Feb. 15, 2008

(87) PCT Pub. No.: WO2007/073032

PCT Pub. Date: Jun. 28, 2007

(65) Prior Publication Data

US 2009/0260891 A1 Oct. 22, 2009

(30) Foreign Application Priority Data

Dec. 21, 2005 (KR) ..... 10-2005-0126562
Mar. 13, 2006 (KR) ..... 20-2006-0006631 U

(51) Int. Cl.
*E02D 5/54* (2006.01)

(52) U.S. Cl. ..... 405/244; 405/232; 405/253; 52/745.17

(58) Field of Classification Search ..... 405/231, 405/232, 244, 253, 252.1; 52/745.17, 831, 52/834, 835; 37/189, 352, 364; 175/394, 175/56, 323, 395
See application file for complete search history.

(56) References Cited

U.S. PATENT DOCUMENTS 4,016,944 A * 4/1977 Wohlfeld ..... 175/394
2008/0295363 A1* 12/2008 Kwon ..... 37/189
2009/0035070 A1* 2/2009 Kwon ..... 405/244

FOREIGN PATENT DOCUMENTS

JP 2001073664 A * 3/2001

* cited by examiner

*Primary Examiner*—Frederick L Lagman
(74) *Attorney, Agent, or Firm*—GWiPS

(57) ABSTRACT

A method of mechanized construction has developed for installing an earth wire under-bracing by using an auger crane and adjustable excavating unit with an auger crane. The extendable excavating unit is mounted to the lower end of an auger shaft of the auger crane and excavation teeth extendable and retractable are mounted to the excavating unit, thereby allowing excavation of a burial hole suitable to the size of the earth wire under-bracing. Whether it is needed to bury the earth wire under-bracing having a larger diameter than the diameter of excavation existing on the auger crane, or bury small-sized earth wire under-bracing, a method for mechanized construction of the earth wire under-bracing is enabled without difficulty by using an auger crane and adjustable excavating unit.

5 Claims, 6 Drawing Sheets

[Fig. 1]
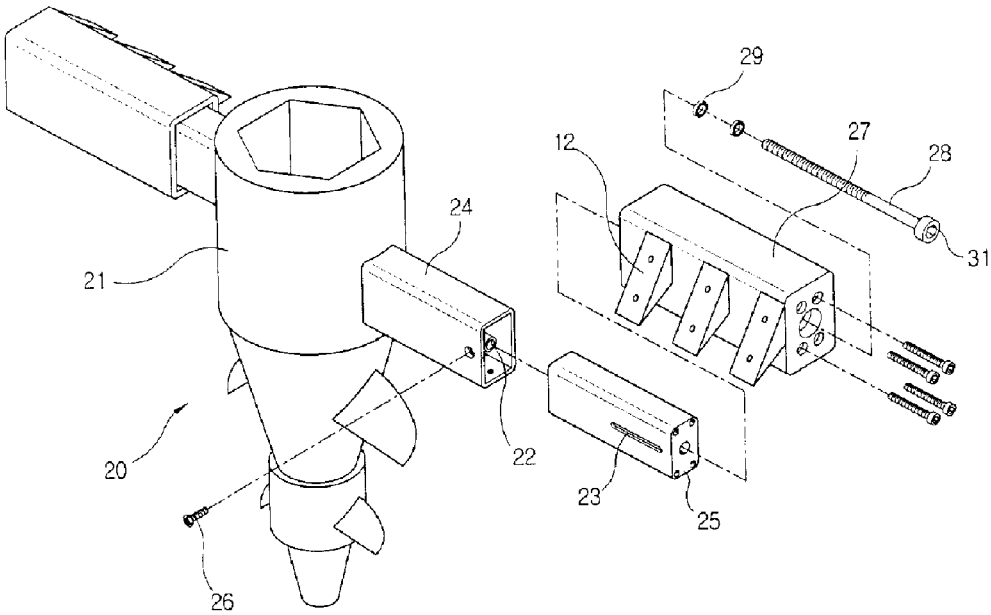
[Fig. 2]
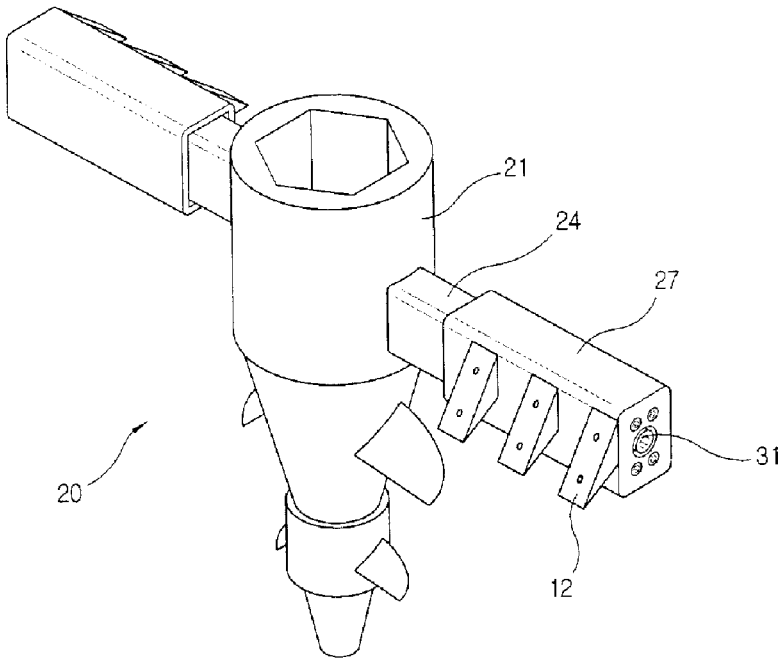

[Fig. 3]
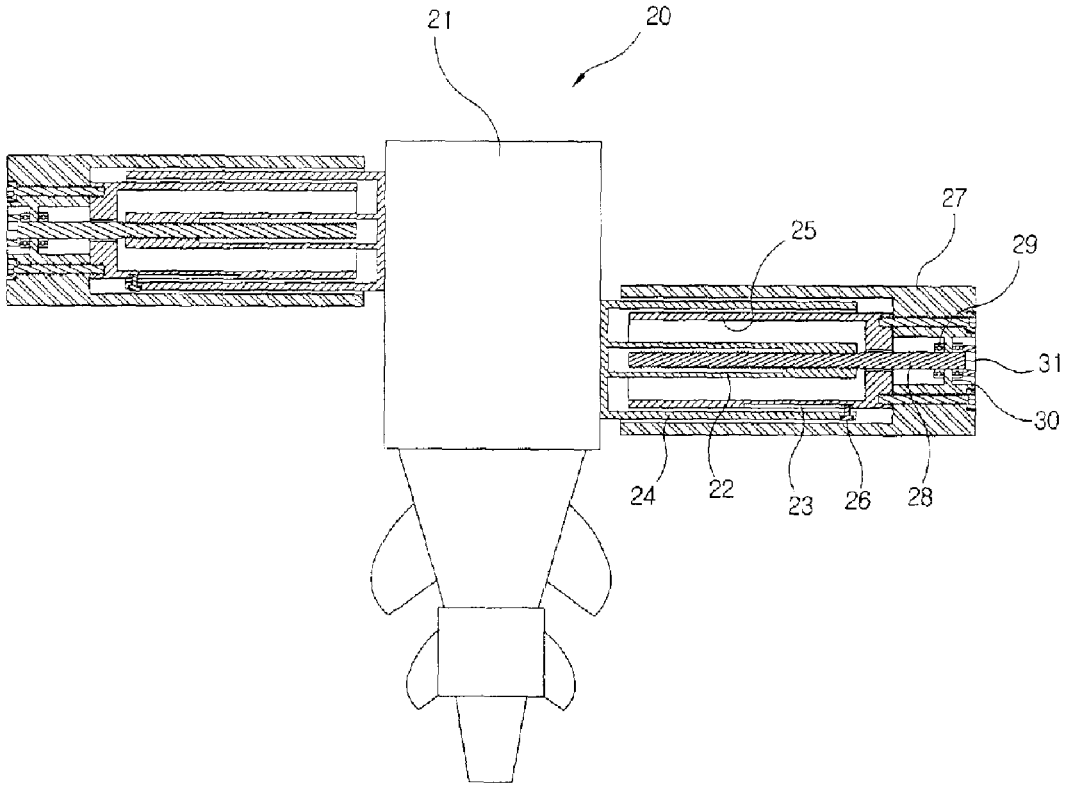
[Fig. 4]
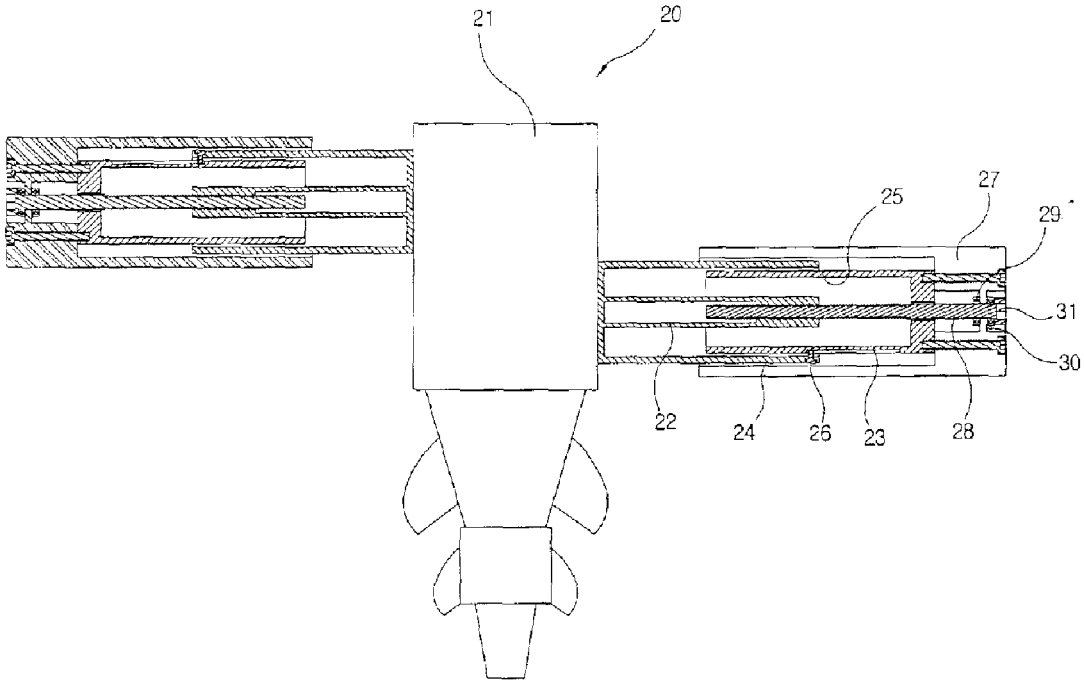

[Fig. 5]
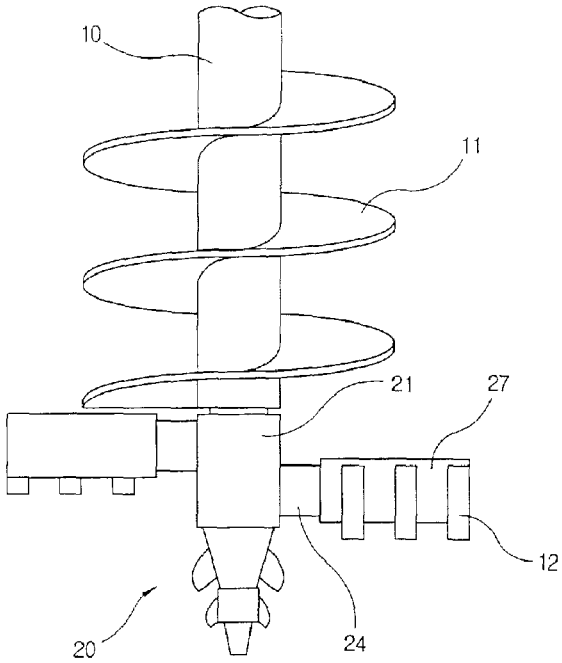
[Fig. 6]
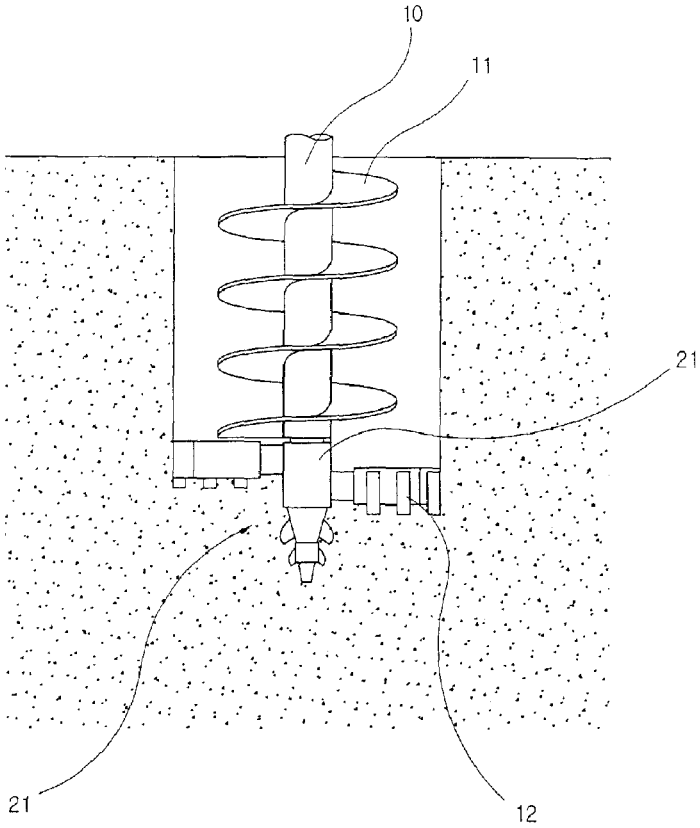

[Fig. 7]
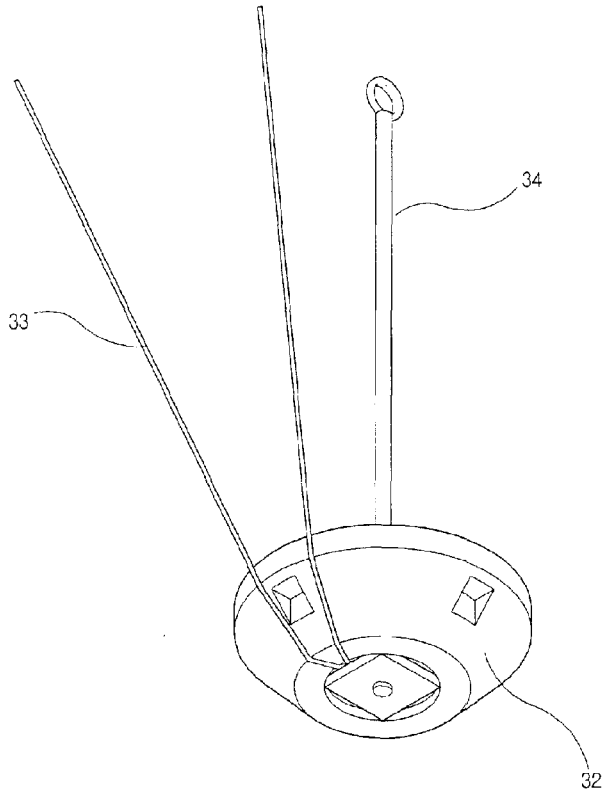
[Fig. 8]
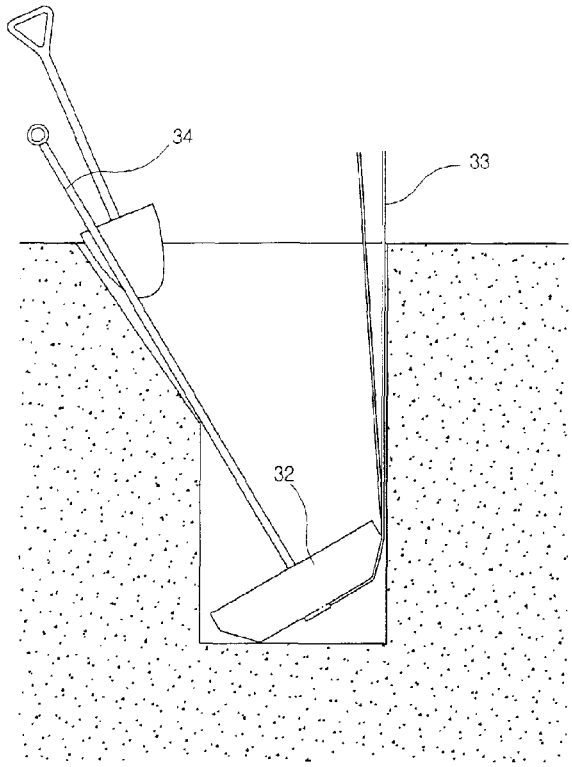

[Fig. 9]
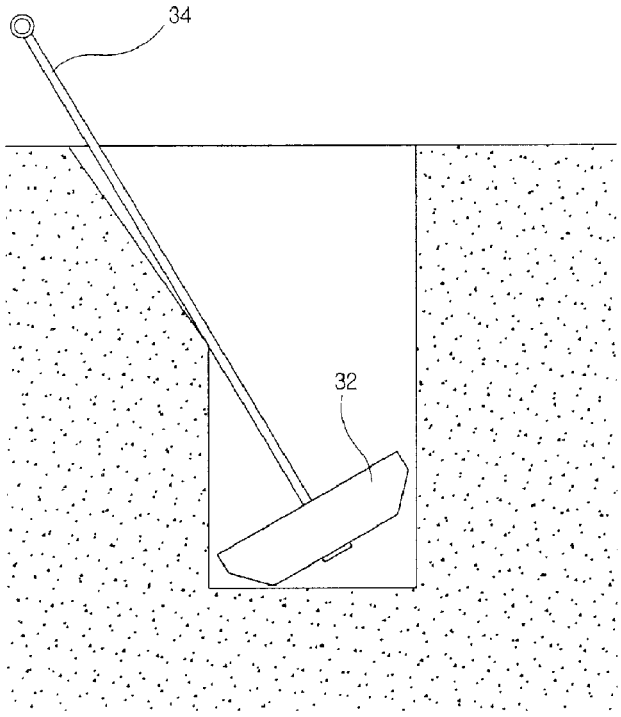
[Fig. 10]
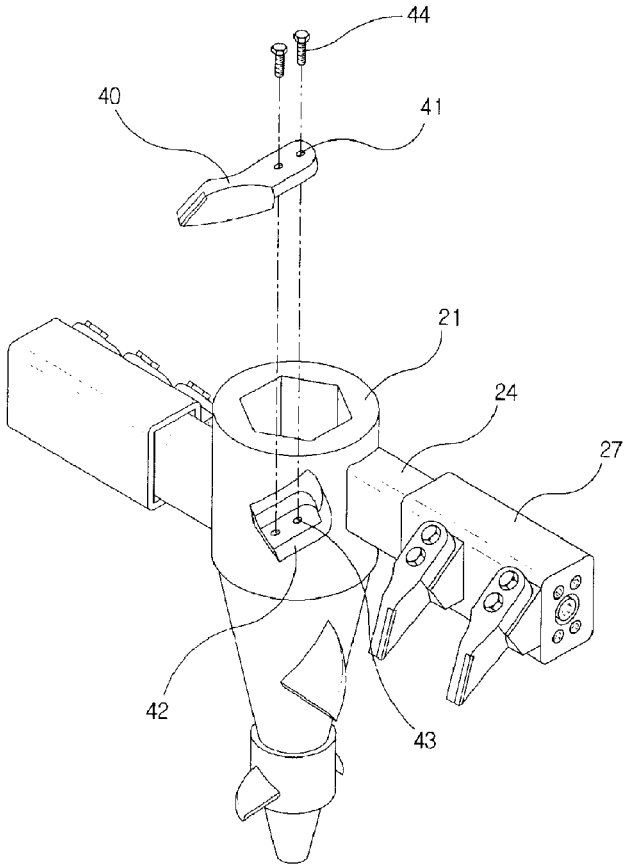

[Fig. 11]
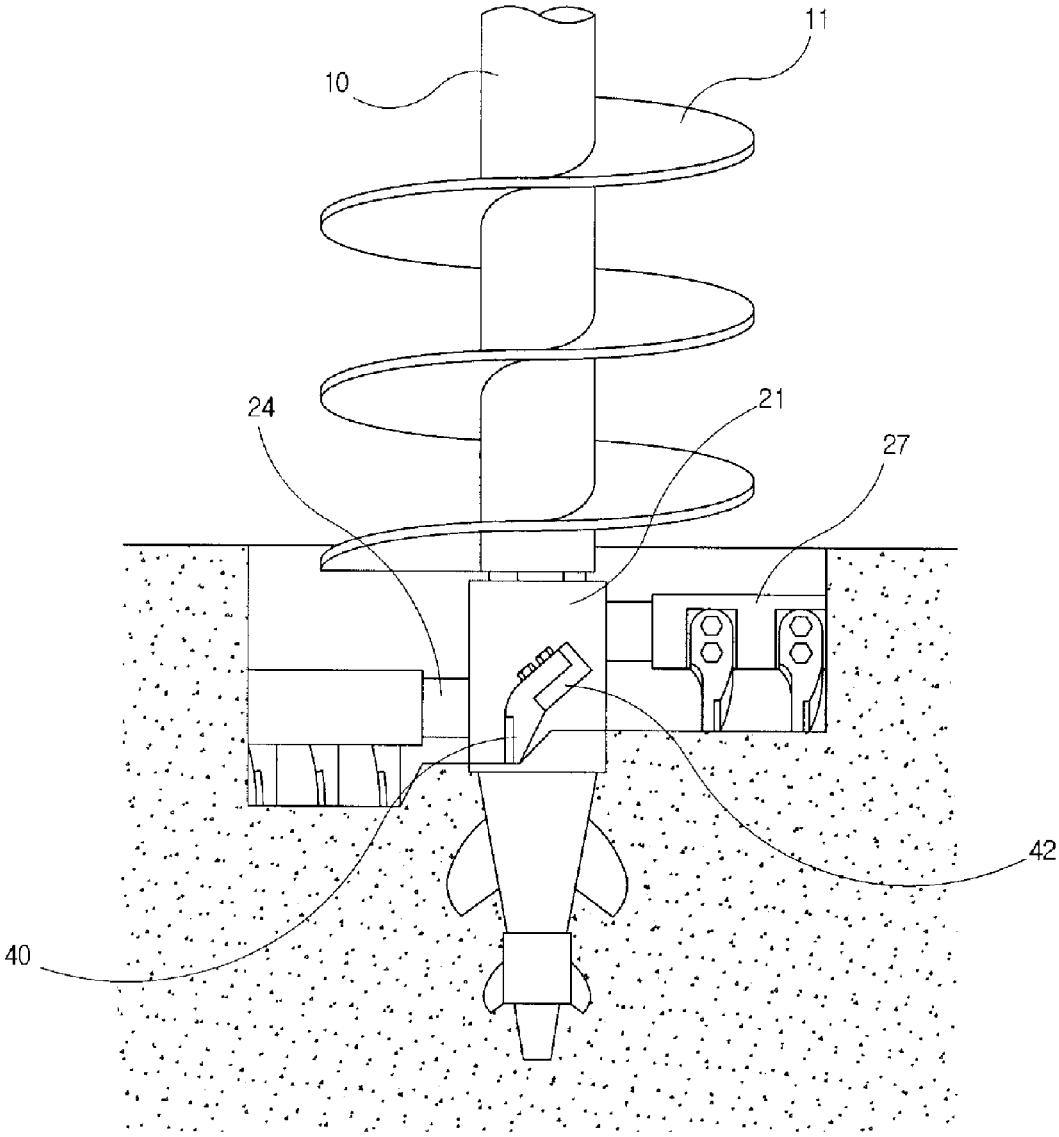

METHOD OF MECHANIZED CONSTRUCTION FOR EARTH WIRE UNDER-BRACING AND EXTENDABLE EXCAVATING UNIT FOR AUGER CRANE

BACKGROUND OF THE INVENTION

1. Field of the Invention

The present invention relates to a method of mechanized construction for earth wire under-bracing for supporting and stabilizing a utility pole, and more particularly to a device and method of mechanized construction for earth wire under-bracing, in which the burial hole for a large-sized earth wire under-bracing can be dug by mounting an extendable excavating unit at the lower end of the auger. A burial hole is constructed for both small-sized and large-sized under-bracing by using the same extendable excavating unit with an auger crane.

2. Description of the Related Prior Art

Generally, in the construction of electrical power transmission and distribution lines and communication lines, if a utility pole is installed and wire and communication cables are strung, earth wires for reinforcing against unbalanced tensile forces of the wires and communication cables are installed, so as to prevent the utility pole from leaning or falling over.

When the earth wire is installed, the excavation work for burying the earth wire under-bracing is first performed by manual labor or machine, and then the earth wire under-bracing is buried in the excavation to be connected by earth wire to the utility pole.

In order to bury such earth wire under-bracing, a burial hole having a predetermined depth should be dug at a spot where the earth wire under-bracing is to be buried. However, where the burial hole is dug by manual labor, it is problematic in that an unnecessarily large burial hole must be dug in order to make sufficient space in the hole for the workers to dig.

As a result, the soil around the excavation site is weakened, thereby relatively degrading the supporting force of the buried earth wire under-bracing when the burial hole is back-filled.

Further, to compensate for the above problem, a vertical excavation hole is dug by using an auger crane, and then an earth wire under-bracing rod is buried and back-filled. However, in the conventional mechanized excavation method, the earth wire rod providing the under-bracing is not at a right angle with the earth wire. Thus, tensile force is generated in the earth wire rod and the under-bracing is lifted out of the ground, allowing the utility pole to lean. This method may cause shoddy and faulty construction.

The under-bracing is commonly made of rectangular blocks, and at the time of construction, the under-bracing is buried horizontally with respect to the utility pole. However, the most ideal construction method is to fasten the under-bracing and the earth wire rod to the utility pole at a right angle.

But, as described above, manual labor leads to excessive labor costs and prolongs the construction time, and the mechanized excavation causes shoddy and faulty construction and weakens the burial supporting force of the under-bracing.

Furthermore, as described above, there is difficulty at many sites, in having to dig a hole in order to bury under-bracing of a rectangular block shape.

Accordingly, Korean Patent Application No. 2005-095892 filed by the applicant of the present invention discloses a mechanized construction method for earth wire under-bracing, in which a burial hole is dug in such a manner that a sloped excavation is dug by an auger crane, or an initial sloped excavation and a second vertical excavation are carried out by stages according to the type of soil. Then earth wire under-bracing of an optimum size is inserted and buried in the hole, and an earth wire rod connected to the earth wire under-bracing is connected to the vertically raised utility pole.

According to the mechanized construction method for earth wire under-bracing for utility poles and the round earth wire under-bracing applied thereto which are disclosed in the aforementioned patent application, the simplification of an excavation process can lead to a reduction in the number of workers and a decrease in working hours. Also, the right angle state between the earth wire rod and the earth wire under-bracing is stably maintained, thereby sharply increasing the supporting force and overcoming problems such as leaning of the utility pole and shoddy and faulty construction. Further, the work environment is improved, keeping people from being angered by inconvenience in traffic, and the construction quality is improved, because it offers excellent protection from natural disasters by providing a firm supporting force, thereby smoothly and reliably supplying high quality power.

The earth wire under-bracing applied to the method disclosed in the aforementioned patent application is a round block when viewed from above, and there are two sizes of earth wire under-bracing, one having a diameter of 43 cm with tolerance: ±5% that is referred to as a small-sized under-bracing, and the other diameter of 62 cm with tolerance: ±5% that is referred to as a large-sized under-bracing. If necessary, a medium-sized under-bracing, which is substituted for 1.0 M conventional under-bracing, can be manufactured and used. The difference in the diameter between the two earth wire under-bracings is determined by considering the variables of the target installation.

The earth wire under-bracings having the aforementioned diameters are for substitution of conventional earth wire under-bracing having rectangular block shapes. The conventional rectangular earth wire under-bracings have lengths of 0.7 M, 1.0 M, and 1.2 M.

In order to bury the earth wire under-bracing manufactured in a round shape, a burial hole having a predetermined inner diameter has to be excavated by using an auger crane. The excavation diameter of an existing auger crane is limited to 50 cm, so using an existing auger crane, it is possible to bury a small-sized under-bracing (43 cm) that is manufactured as a substitute for a 0.7 M earth wire under-bracing, but impossible to perform a mechanized construction of a large-sized under-bracing (62 cm) that is manufactured as a substitute for 1.0 M and 1.2 M earth wire under-bracings.

Therefore, in order to bury a large-sized earth wire under-bracing having a diameter of 62 cm, excessive labor hours are consumed by manual labor excavation, so it is very uneconomical. Further, the construction quality and the construction techniques are not standardized, thereby sharply degrading the working efficiency.

SUMMARY OF THE INVENTION

To overcome the aforementioned problem, it is an object of the present invention to provide a mechanized construction method for earth wire under-bracing, which is a new technological method of digging a burial hole suitable for the size of the earth wire under-bracing, by mounting an excavation unit at the lower end of an auger crane, and bilaterally extending or retracting the excavation unit, thereby improving its operating capacity.

It is another object of the present invention to provide an extendable excavating unit for an auger crane that enables mechanized construction of a large-sized earth wire under-bracing, which reduces working hours and labor, improves the construction quality and working efficiency, and improves the business efficiency of a construction company.

It is still another object of the present invention to provide an extendable excavating unit for an auger crane, which can shorten the construction hours of mechanized earth wire construction and utility pole work, by improvement of excavation speed. Excavation load and stress during machine excavation are sharply reduced by an auxiliary blade, which can be used very effectively at an excavation site in firm ground, such as rotten stone, and can greatly lengthen the life span of the excavating unit.

According to the mechanized construction method for earth wire under-bracing and the extendable excavating unit for an auger crane, it is possible to perform a mechanized construction of earth wire under-bracing, reduce the construction hours and labor, improve the construction stability and working efficiency by improvement of construction quality and mechanization of construction technique, and contribute to the growth of a construction company.

BRIEF DESCRIPTION OF THE DRAWINGS

FIG. 1 is an exploded perspective view of an extendable excavating unit for an auger crane according to the present invention.

FIG. 2 is a perspective view of an assembled extendable excavating unit for an auger crane according to the present invention.

FIG. 3 is a cross-sectional view of an excavating unit for forming a burial hole for a small-sized under bracing according to the present invention.

FIG. 4 is a cross-sectional view of an excavating unit showing an extended state for forming a burial hole for a large-sized under-bracing according to the present invention.

FIG. 5 is a front view showing the entire parts of the auger having an extended excavating unit according to the present invention.

FIG. 6 is a cross-sectional view showing an excavation process using an extended excavating unit according to the present invention.

FIG. 7 is a perspective view showing a process of fastening an earth wire rod and an earth wire under-bracing and connecting a rope to the lower part of the under-bracing having the earth wire rod.

FIG. 8 is a cross-sectional view showing a process of removing earth and sand of an earth wire rod interference area according to the present invention.

FIG. 9 is a cross-sectional view showing a state in which the installation of earth wire under-bracing is finished before back filling of the burial hole according to the present invention.

FIG. 10 is an exploded perspective view of a primary part showing an extendable excavating unit for an auger crane according to another embodiment of the present invention.

FIG. 11 is a cross-sectional view showing an excavation created by an extendable excavating unit for an auger crane according to another embodiment of the present invention.

DESCRIPTION OF THE PREFERRED EMBODIMENTS

Hereafter, a preferred embodiment of the present invention will be described. FIG. 1 is an exploded perspective view of an adjustable excavating unit for an auger crane according to the present invention. FIG. 2 is a perspective view of an assembled adjustable excavating unit for an auger crane according to the present invention. FIG. 3 is a cross-sectional view of an excavating unit for forming an excavation hole for a small-sized under bracing according to the present invention, and FIG. 4 is a cross-sectional view of an excavating unit showing an extended state for forming an excavation hole for a large-sized under-bracing according to the present invention.

An extendable excavating unit for an auger crane for mechanized construction of earth wire under-bracing for utility pole work is mounted to the excavating end portion of an auger shaft 10 having a spiral auger scoop blade 11 formed thereon, and has protruded excavation teeth 12 disposed opposite to each other.

The extendable excavating unit comprises an excavating unit 20 mounted to the excavating end portion of the auger shaft 10.

The excavating unit 20 includes supporting units 24 protruding from opposite sides, covering units 27 which can slide along the supporting units 24 and have protruding excavation teeth 12 attached to one side. The covering units can be extended or retracted by sliding in a longitudinal direction with respect to their supporting units 24. The excavating unit 20 includes a body 21 coupled to the excavating end portion of the auger shaft 10, and the supporting units 24 having threaded pipe 22 inside. An adjusting bolt 26 fastened to the outer surface so as to move transversely is disposed on both sides of the body 21.

A tubular adjusting unit 25 is inserted into the inner peripheral surface of the supporting unit 24, and a slot 23, into which the adjusting bolt 26 is inserted, is formed on the outer peripheral surface of the adjusting unit 25.

A screw shaft 28, screwed to the threaded pipe 22, penetrates from the outer end of the adjusting unit 25 so as to be screwed to the covering unit 27 having the excavation teeth 12, thereby coupling the screw shaft 28 to the center of the covering unit 27, by the rotation of the screw shaft 28.

The adjusting unit 25 and the covering unit 27 slide along the supporting unit 24 by the rotation of the screw shaft 28.

The screw shaft 28 is supported by the bearing 29 mounted in the covering unit 27, allowing the screw shaft to rotate. The adjusting head portion 31 formed at one end of the screw shaft 28 is recessed, flush to the surface at the outside end of the covering unit 27, and the bearing 29 coupled to the screw shaft 28 is prevented from moving in a longitudinal direction by the bearing seat 30 formed inside the covering unit 27, thereby supporting the screw shaft 28, so that it can rotate, in its original position.

The supporting units 24 at both sides formed on the body 21 of the excavating unit 20 are disposed to have a different height in a longitudinal direction of the body 21 so as to reduce the excavation load.

The excavating unit 20 further comprises an auxiliary excavation blade 40 which has mounting holes 41 and is coupled to one side surface of the body 21. The excavating unit 20 has a mounting fixture 42 protruding from the body 21 in a downward sloping state, and fastening holes 43 formed on the mounting portion 42. The auxiliary excavation blade 40 is mounted to the body 21 by an attaching bolt 44, with the mounting hole 41 of the auxiliary excavating unit 40 and the fastening hole 43 being made to line up with each other.

In the drawings, unexplained reference numeral 32 represents an earth wire under-bracing, 33 represents a rope, and 34 represents an earth wire rod. Hereafter, the thus-constructed extendable excavating unit for an auger crane for a mechanized construction for earth wire under-bracing will be described in more detail according to the present invention, with reference to the accompanying drawings.

An extendable excavating unit 20 according to the present invention, as shown in the drawings, is used by being coupled to the lower end of an auger shaft 10 having a spiral auger scoop blade 11 on the outer peripheral surface thereof.

A supporting unit 24 of a rectangular tube shape protrudes on both sides of the body 21 of the excavating unit, and a threaded pipe 22 having a female thread is positioned inside the supporting unit 24. In addition, an adjusting unit 25 is inserted into the supporting unit 24. The supporting unit is coupled to a covering unit 27 having a plurality of sloped excavation teeth 12. A slot 23 is formed along the longitudinal dimension on the outer surface of the adjusting unit 25. The front end of the adjusting bolt 26, installed through a hole formed at the outer end of the supporting unit 24, is inserted into slot 23.

Accordingly, as the adjusting unit 25 slides along the supporting unit 24, the sliding distance of the adjusting unit 25 is restricted by the length of the slot 23 in the adjusting unit 25, into which the front end of the adjusting bolt 26 is inserted.

Further, the covering unit 27 having a plurality of excavation teeth 12 is coupled to one end portion of the adjusting unit 25. A screw shaft 28 screwed to a threaded pipe 22 of the supporting unit is installed within the center of the covering unit 27 along the length dimension. The screw shaft 28 is installed so that it is free to rotate within the covering unit 27 by a plurality of bearings.

That is, the screw shaft 28 inserted into the center of the covering unit 27 is supported, free to rotate, by the bearings 29 disposed at both sides of the bearing seat 30 formed within the covering unit 27. Further, an adjusting head portion 31 of a hexagonal shape is formed at one end of the screw shaft 28, thereby the screw shaft 28 may be easily rotated by using a tool at the outer end of the covering unit 27 during the assembling work.

In the above-described coupled state, if a worker rotates the screw shaft 28 mated to the threaded pipe 22 of the supporting unit 24, the relative distance from the adjusting unit and the covering unit to the supporting unit is adjusted. That is, according to the rotation of the screw shaft 28, the covering unit 27 having the excavation teeth 12 and the adjusting unit 25 can be extended or retracted. This occurs by moving the covering unit 27 and the adjusting unit 25 according to the rotation of the screw shaft 28 since the threaded pipe 22 mated to the screw shaft 28 is fixed to the body 21 through the supporting unit 24.

If it is desired to construct a small-sized under-bracing, both sets of excavation teeth 12 of the excavating unit 20 are moved inward toward the body 21 so as to ensure a minimum width. Therefore, it is possible to excavate a burial hole suitable for a small-sized under-bracing, earth wire construction work, and an existing utility pole. On the contrary, if it is desired to construct a large-sized under-bracing, both sets of excavation teeth 12 are extended outward so as to ensure a maximum width. Accordingly, it is possible to excavate a hole suitable for a large-sized under-bracing.

A construction process for a large-sized earth wire under-bracing using such an excavating unit 20 will be described.

First, as shown in FIG. 5, the excavation teeth 12 of the excavating unit 20 attached to a lower part of the auger shaft 10 are extended by the rotation of the screw shaft 28. In this state, as shown in FIG. 6, when a construction site is excavated, a burial hole into which a large-sized under-bracing can be inserted is produced.

Afterwards, as shown in FIG. 7, a rope 33 is hung on a lower part of the earth wire under-bracing 32, and the earth wire under-bracing 32 is inserted into the burial hole. When the rope is hung on a fastening portion of the earth wire under-bracing 43 and the earth wire under-bracing is put into the excavation hole by cooperative work, the rear end portion of the earth wire under-bracing 32 is lifted by the rope, whereby a landfill angle of the earth wire under-bracing can be maintained with respect to the earth wire rod 34.

In this state, the rope 33 is removed, and earth and sand present in the interference area of the earth wire rod 34 and the shoulder of the excavation are shaved off using a scoop or other tool, as shown in FIG. 8, forming a sloping surface. Next, as shown in FIG. 9, the earth wire rod 34 and the earth wire under-bracing 32 are disposed so as to have a predetermined sloping angle by using the sloping surface, and then the excavation hole is back filled.

The above-described construction steps are for constructing a large-sized earth wire under-bracing. Meanwhile, if it is desired to construct a small-sized under-bracing, the excavation teeth 12 of the covering units are moved toward the body 21 by rotating the screw shafts 28 to retract the covering units. The earth wire under-bracing is then constructed by the above-described process.

Accordingly, it is possible to retract or extend the excavation teeth, thus a general construction is enabled regardless of the size of the earth wire under-bracing.

In addition, as the excavation teeth 12 are moved by the rotation of the excavating unit 20, the ground surface is penetrated. The excavation teeth 12 are attached to the body 21 of the excavating unit 20 at different heights in a longitudinal direction, thus the excavation work into the ground is performed more effectively by breakout forces depending on a difference in height.

Further, an auxiliary excavation blade 40 is mounted at one side of the body 21 having the above-described excavation teeth 12. Additional excavation work is carried out by the auxiliary excavation blade 40 positioned between the excavation teeth 12 of the covering units 27. When the covering units 27 are not extended, the ground surface is pre-excavated, thereby reducing the load and stress applied to the existing auger crane so as to perform the excavation work more quickly.

The above-described auxiliary blade 40 is mounted on a mounting fixture 42 protruding in a downward sloped state on one side of the body 21 of the excavating unit 20. A mounting hole 41 is formed on the auxiliary excavation blade 40, and a fastening hole 43 having a screw thread is formed on the mounting fixture 42 opposed to the mounting hole 41. Therefore, the auxiliary excavation blade 40 can be firmly mounted on the mounting fixture 42 by fastening a mounting bolt 44 to the screw thread of the mounting fixture.

By such a mounting structure for the auxiliary excavation blade 40, it is possible to replace an auxiliary excavation blade 40 that is abraded or damaged by shock.

As shown in FIG. 11, when a hole is dug by using the excavating unit of the present invention, in the process of excavating by one of the excavation teeth 12 of the covering units 27 positioned at the lower part of the body 21, a portion that is not excavated by the excavation teeth is formed in the area between the covering units 27. This unexcavated portion is excavated by the auxiliary excavation blade 40, thereby relatively reducing the load and stress applied to the auger crane.

Such an excavating unit can be used more effectively at an excavation site whose ground is not level, or which has a firm ground like rotten stone, or which is made of a gravel layer.

Further, the auxiliary excavation blade 40 reduces the load, and provides a crushing action on some parts of the gravel layer, thereby enabling faster and stabilized excavation work.

According to the mechanized construction method for earth wire under-bracing and an extendable excavating unit for an auger crane for the method according to the present invention, it is possible to perform a mechanized construction of earth wire under-bracing by using an auger crane, and reduce the construction hours and labor. Moreover, the construction quality is improved, and the construction stability and the working efficiency are enhanced, thereby contributing to the improvement of business efficiency of a construction company.

What is claimed is:

1. A method of mechanized construction for earth wire under-bracing for a utility pole work, the method comprising the steps of:

mounting excavation teeth having an excavating unit extendable/retractable in a transverse direction, on the excavating end portion of an auger for an auger crane, digging a burial hole having diameter of the earth wire under-bracing (33) and depth of 8-10th earth wire rod (34) by using the excavation teeth of the excavating unit whose extension width is adjusted according to the size of the earth wire under-bracing, removing soil and sand from an interference area of earth wire rod for burying the earth wire under-bracing in the burial hole, hanging a rope on a lower part of the earth wire under-bracing to be buried and lowering the earth wire under-bracing into the burial hole by the rope, and filling soil to the excavation hole, which the earth wire under-bracing is buried.

2. An extendable excavating unit for an auger crane for mechanized construction for earth wire under-bracing for utility pole work comprising:

an excavating unit (20) mounted to the excavating end portion of the auger shaft (10) having a spiral auger scoop blade (11), a covering unit (27) which can slide along the supporting unit (24) and protruding excavation teeth (12) mounted on the covering unit (27), a body (21) coupled to an excavating end portion of the auger shaft (10), and the supporting unit (24) having a threaded pipe (22) inside and an adjusting bolt (26) fastened to the outer surface, so as to move transversely, is disposed on both sides of the body (21), a tubular adjusting unit (25) is inserted into the inner peripheral surface of the supporting unit (24), a slot (23) into which an end portion of the adjusting bolt (26) is inserted is formed on the outer peripheral surface of the adjusting unit (25), and a screw shaft (28) mated to the threaded pipe (22), penetrates from the outer end of the adjusting unit (25) so as to be screwed to the covering unit (27) having the excavation teeth (12), thereby coupling the screw shaft to the center of the covering unit (27), wherein said adjusting unit (25) and covering unit (27) slide along the supporting unit (24) according to the rotation of the screw shaft (28).

3. The extendable excavating unit of claim 2, wherein the screw shaft (28) is supported by the bearing (29) mounted in the covering unit (27), the adjusting head portion (31) formed at one end of the screw shaft (28) is recessed flush at the outer end of the covering unit (27), and the bearing (29) coupled to the screw shaft (28) is prevented from moving in a longitudinal direction by the bearing seat (30) formed inside the covering unit (27), thereby supporting the screw shaft (28) and allowing it to rotate in its original position.

4. The extendable excavating unit of claim 2, wherein the supporting units (24) at both sides formed on the body (21) of the excavating unit (20) are at different heights in a longitudinal direction of the body (21) so as to reduce the excavation load.

5. The extendable excavating unit of claim 2, wherein the excavating unit (20) further comprises an auxiliary excavation blade (40) which has an mounting hole (41) to be coupled to one side surface of the body (21), the excavating unit (20) has a mounting fixture (42) protruding from the body (21) in a downward sloping state, a fastening hole (43) formed on the fixing portion (42), the auxiliary excavation blade (40) is mounted to the body (21) by a mounting bolt (44) with the fixing hole (41) of the auxiliary excavating unit (40) and the fastening hole (43) being made to line up with each other.

* * * * *